US006227184B1

(12) United States Patent
Katayama et al.

(10) Patent No.: US 6,227,184 B1
(45) Date of Patent: May 8, 2001

(54) BLOW-BY GAS VENTILATION SYSTEM FOR ENGINE

(75) Inventors: Goichi Katayama; Masanori Takahashi, both of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/557,863

(22) Filed: Apr. 26, 2000

(30) Foreign Application Priority Data

Apr. 27, 1999 (JP) ..... 11-119574

(51) Int. Cl.[7] ..... F01M 13/00
(52) U.S. Cl. ..... 123/572; 123/184.24
(58) Field of Search ..... 123/572, 573, 123/574, 182.24, 182.34, 184.42, 184.47

(56) References Cited

U.S. PATENT DOCUMENTS 5,005,933 * 4/1991 Rush, II et al. ..... 123/572
5,488,939 2/1996 Nakai et al. .
5,899,197 * 5/1999 Watanabe et al. ..... 123/572
6,009,863 * 1/2000 Tochizawa ..... 123/572

* cited by examiner

*Primary Examiner*—Marguerite McMahon
(74) *Attorney, Agent, or Firm*—Knobbe, Martens, Olson & Bear, LLP

(57) ABSTRACT

A blow-by gas ventilation system for a crankcase of an engine includes an improved construction for distributing blow-by gases more evenly between multiple cylinders. The engine has an air intake device that includes a plurality of air delivery conduits for the cylinders and a plenum chamber housing disposed upstream of the air delivery conduits. The ventilation system comprises a blow-by gas conduit that couples the crankcase with the plenum chamber housing. The plenum chamber housing includes an opening to which the blow-by gas conduit is connected. A baffle is disposed in front of the opening within the plenum chamber housing so as to divide the blow-by gases equally for the respective cylinders.

25 Claims, 5 Drawing Sheets

BLOW-BY GAS VENTILATION SYSTEM FOR ENGINE

PRIORITY INFORMATION

This application is based on and claims priority to Japanese Patent Application No. Hei 11-119574, filed Apr. 27, 1999, the entire contents of which is hereby expressly incorporated by reference.

BACKGROUND OF THE INVENTION

1. Field of the Invention

This invention relates to a ventilation system for an engine, and more particularly to a blow-by gas ventilation system suitable for a marine drive.

2. Description of Related Art

An internal combustion engine typically includes a cylinder body defining at least one cylinder bore. A piston reciprocates in the cylinder bore. A cylinder head is affixed to one end of the cylinder body and defines a combustion chamber with the cylinder bore and the piston. A crankcase member is affixed to the other end of the cylinder body and defines a crankcase chamber with the cylinder body. A crankshaft is journaled within the crankcase chamber and is connected to the piston for rotation with the reciprocal movement of the piston. The piston is provided with at least one piston ring to isolate the combustion chamber from the crankcase chamber.

Ideally, combustion gases and unburnt air/fuel charges in the combustion chamber never blow by the piston rings into the crankcase chamber. In practice, however, some combustion gases and unburnt charges (hereinafter collectively referred to as "blow-by gases") are blown by the piston ring into the crankcase chamber during combustion. A two-stroke engine allows the blow-by gases to return to the combustion chamber through scavenge passages for burning. In a four-stroke engine, however, the blow-by gases accumulate in the crankcase chamber or in a lubricant reservoir, which is usually coupled with the crankcase chamber. Accordingly, the pressure in the crankcase chamber and the lubricant reservoir inevitably increases. This high pressure decreases engine output. Additionally, deterioration of the lubricant, including a viscosity decrease, and oil leakage from an oil inlet, oil gauge and the like, due to the increased pressure can occur.

In order to resolve these problems, conventional engines are typically provided with ventilation systems. A compulsory circulation type ventilation system is known as one of such systems. This type of system employs an air circulation unit that introduces ambient air via an air induction device and compels it into flowing through the crankcase and lubricant reservoir to sweep away the blow-by gases therein to the air induction device. Although this system is quite effective, a large space is necessary for its application.

Outboard motors today commonly employ four-stroke engines. The engines of the outboard motors are usually surrounded by protective cowling assemblies and hence such large size ventilation systems are not suitable for the outboard motors.

Ventilation systems in simple and compact constructions are, therefore, employed with the outboard motors. The systems have no compulsory air circulation units but simply have blow-by gas conduits that couple the crankcases to the air induction devices, specifically, to plenum chambers. The blow-by gases are led to oil separators or breathers that are provided to remove an oil component. After the oil separators remove the oil component contained in the gases, the blow-by gases are distributed to the combustion chambers through the air induction devices to be burnt in the combustion chambers.

Many engines have a multiple combustion chambers because of the requirement for larger outputs. The air induction devices for such engines have plurality of air delivery conduits that communicate with the respective combustion chambers. In the outboard motors, the delivery conduits extend generally vertically and are spaced apart from each other. If, for example, the blow-by gas conduits are connected atop of the plenum chambers, the blow-by gases are likely to flow into the upper delivery conduits rather than the lower conduits. Due to the imbalance flow of the blow-by gases, the air/fuel ratio of the air/fuel charges delivered to the respective combustion chambers are different from each other. As a result, the combustion conditions for the respective combustion chambers are dissimilar and hence, engine components such as pistons, connecting rods and bearings should have different endurance in each cylinder. This difference in the air/fuel ratio delivered to the cylinder can also produce an imbalance between the power outputs from the cylinders which degrades engine performance. A need therefore exists for an improved blow-by gas ventilation system that generally distributes the blow-by gas evenly between the cylinders.

SUMMARY OF THE INVENTION

In accordance with one aspect of the invention, a ventilation system is provided for a crankcase of an internal combustion engine. The engine has an air induction device that includes a plurality of air delivery conduits and a plenum chamber member disposed upstream of the air delivery conduits. The ventilation system comprises a blow-by gas conduit communicating with the crankcase and with the plenum chamber member to deliver blow-by gases from the crankcase to the plenum chamber. The plenum chamber member includes an opening to which the blow-by gas conduit is connected. A baffle is disposed in front of the opening within the plenum chamber member.

In accordance with a further aspect of the present invention, an internal combustion engine comprises a plurality of combustion chambers and an air intake system. The air induction system includes a plurality of air delivery conduits and a plenum chamber member. The delivery conduits are connected to the respective combustion chambers. The plenum chamber is disposed upstream of the air delivery conduits. A crankcase is provided. A ventilation system is provided and includes a blow-by gas conduit that communicates with the crankcase and with the plenum chamber member. The plenum chamber member has an opening to which the blow-by gas conduit is connected. The ventilation system further includes a baffle disposed in front of the opening within the housing.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention.

DETAILED DESCRIPTION OF THE PREFERRED EMBODIMENT OF THE INVENTION

Figure 1:
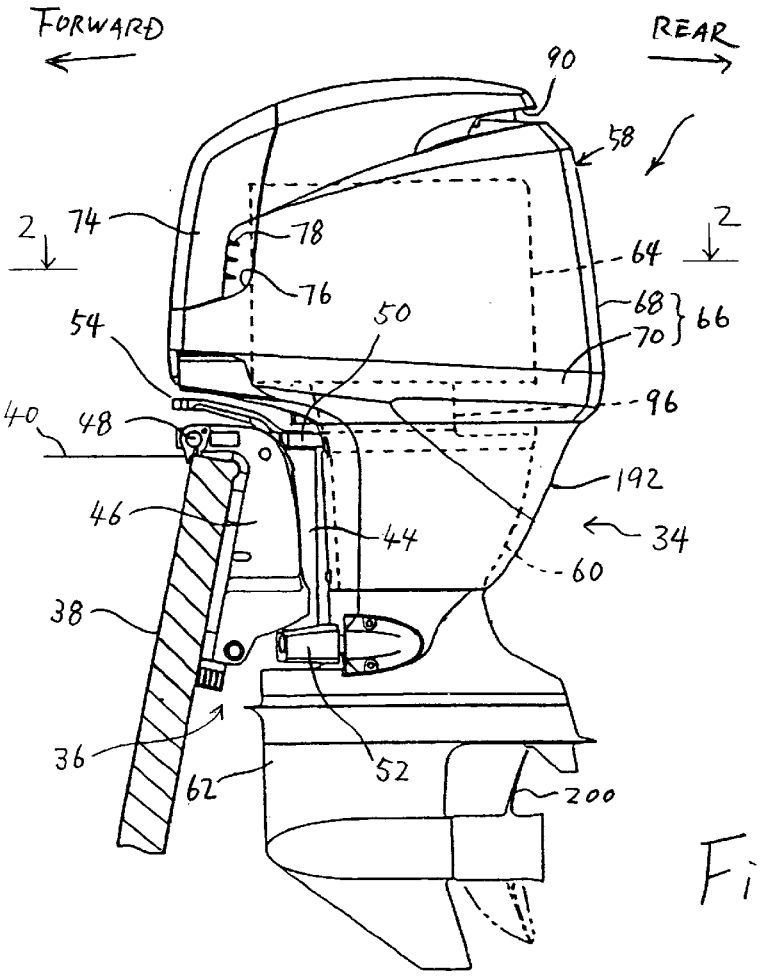
FIG. 1(A) is a side elevational view of an outboard motor employing an engine that includes a blow-by gas ventilation system constructed in accordance with a preferred embodiment of the present invention.
FIG. 1(B) is a top plan view of the outboard motor, specifically, a top cowling thereof.
Figure 1:
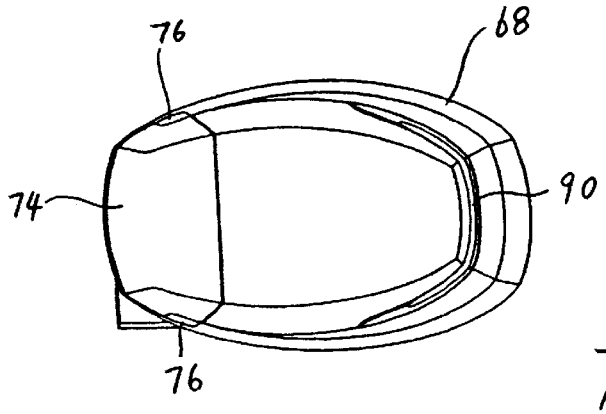

With reference to FIGS. 1(A) to 5, an outboard motor 30 incorporates a blow-by gas ventilation system 32 configured in accordance with a preferred embodiment of the present invention. Although the present invention is shown in the context of an engine for an outboard motor, various aspects and features of the present invention also can be employed with engines for other types of marine outboard drive units (e.g., a stem drive unit) and also with other types of engines (e.g., land vehicle engines and stationary engines).

In the illustrated embodiment, the outboard motor 30 comprises a drive unit 34 and a bracket assembly 36. The bracket assembly 36 supports the drive unit 34 on a transom 38 of an associated watercraft 40 so as to place a marine propulsion device in a submerged position with the watercraft 40 resting on the surface of a body of water. The bracket assembly 36 comprises a swivel bracket 44, a clamping bracket 46, a steering shaft and a pivot pin 48.

The steering shaft extends through the swivel bracket 44 and is affixed to the drive unit 34 with an upper mount assembly 50 and a lower mount assembly 52. The steering shaft is pivotally journaled for steering movement about a generally vertically extending steering axis within the swivel bracket 44. A steering handle 54 extends upwardly and forwardly from the steering shaft to steer the drive unit 34. The clamping bracket 46 includes a pair of bracket arms spaced apart from each other and affixed to the transom 38 of the associated watercraft 40. The pivot pin 48 completes a hinge coupling between the swivel bracket 44 and the clamping bracket 46. The pivot pin 48 extends through the bracket arms so that the clamping bracket 46 supports the swivel bracket 38 for pivotal movement about a generally horizontally extending tilt axis of the pivot pin 48.

As used through this description, the terms "fore," "front," "forward" and "forwardly" mean at or to the side where the clamping bracket 46 is located, and the terms "aft," "rear," "reverse" and "rearwardly" mean at or to the opposite side of the front side, unless indicated otherwise.

Although not shown, a hydraulic tilt system is provided between the swivel bracket 44 and clamping bracket 46 to tilt up and down and also for the trim adjustment of the drive unit 34. Since the construction of the bracket assembly 36 is well known in the art, further description is not believed to be necessary to permit those skilled in the art to practice the invention.

The drive unit 34 includes a power head 58, a driveshaft housing 60 and a lower unit 62. The power head 58 is disposed atop of the drive unit 34 and includes an internal combustion engine 64 and a protective cowling assembly 66. The protective cowling assembly 66 includes a top cowling 68 and a bottom cowling 70.

The protective cowling assembly 66 generally completely encloses the engine 64. The top cowling 68 is detachably affixed to the bottom cowling 70 with a conventional coupling mechanism 72 (see FIGS. 3 and 4) so that the operator can access the engine 64 for maintenance or for other purposes.

Figure 2:
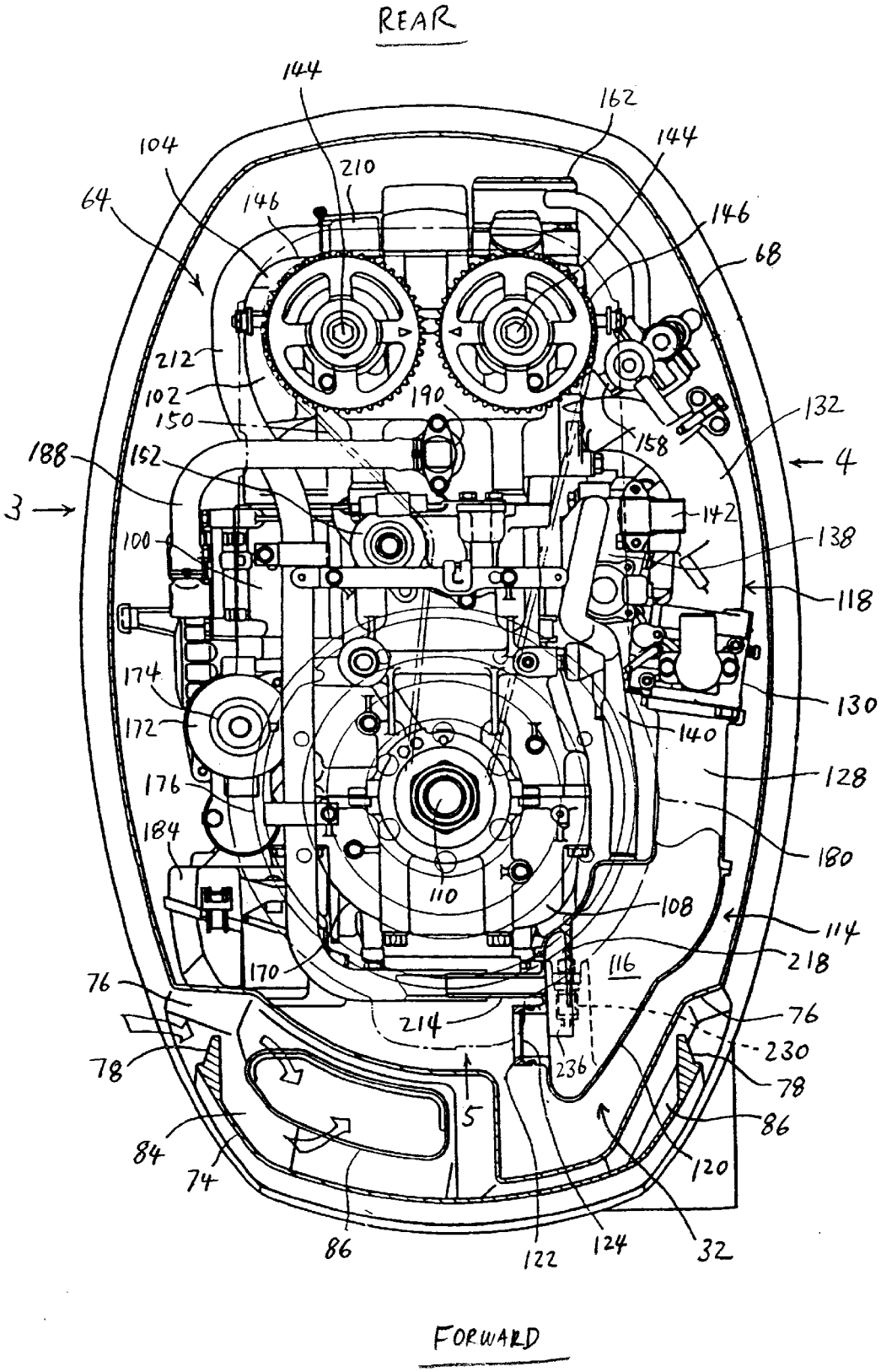
FIG. 2 is a top plan view showing a power head of the motor. The top cowling is sectioned along the line 2—2 of FIG. 1(A). An air induction device is also partially sectioned and somewhat schematically indicated.

In the illustrated embodiment, the top cowling 68 has a separate front cover 74 which is detachably affixed to the top cowling 68. Front air intake openings 76 are formed on both sides of the power head 58 and between the top cowling 68 and the front cover 74. As seen in FIG. 2, the front cover 74 has a plurality of projections 78 extending rearwardly to inhibit water and substances other than air from entering the interior of the cowling assembly 66.

Figure 3:
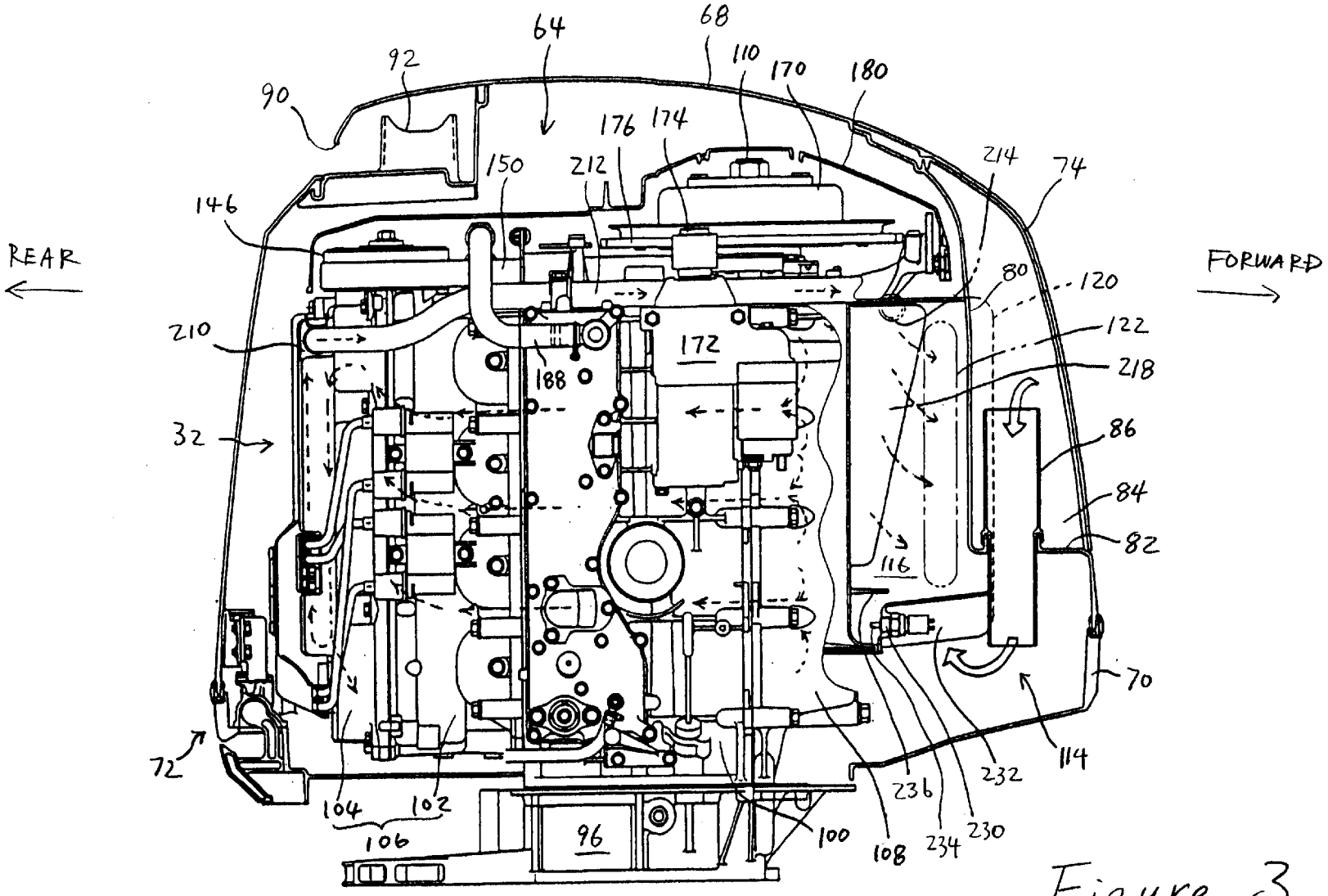
FIG. 3 is a side elevational view of the power head looking in the direction of Arrow 3 of FIG. 2 to particularly show the engine on the starboard side. The top cowling is sectioned generally along a center line of the cowling and also along a line crossing a front air duct. The air induction device is also partially sectioned.

As best seen in FIG. 3, a front end of the top cowling 68 is recessed and its vertically extending portion 80 and bottom portion 82 together define a front air compartment 84 with the front cover 74. As seen in FIG. 2, the bottom portion 82 has a through-hole that holds a front air duct 86 in a known manner. An upper portion of the air duct 86 extends in the air compartment 84 with a certain length, while a lower portion thereof extends in the interior of the cowling assembly 66 also with a certain length. Ambient air can enter the interior of the cowling assembly 66 through the front air intake openings 76 and the front air duct 86. As seen in FIG. 2, the front air duct 86 is actually partial to the starboard side and hence the intake opening 76 on the port side is coupled to the air compartment 84 through a channel 85. The air introduced through this route is primarily applied for forming air charges for the engine 64, but it also is used to cool electrical equipment disposed forwardly of the engine 64. The front air duct 86 will be described again later.

The top cowling 68 also has a rear air intake opening 90 disposed on its rear and top portion. A pair of rear air ducts 92 are formed on an inner top portion of the cowling 68 so that ambient air also can enter the interior of the cowling assembly 66 through the rear air intake opening 90 and the rear air ducts 92. The air introduced through this route is primarily used for cooling the engine 64 and/or engine components.

The bottom cowling 70 has an opening at its bottom portion through which an exhaust guide 96 extends. The exhaust guide 96 is affixed atop of the driveshaft housing 60. The bottom cowling 70 and the exhaust guide 96, thus, generally form a tray. The engine 64 is placed onto this tray and is affixed to the exhaust guide 96 to be supported thereby. The exhaust guide 96 also has an exhaust passage therein, through which a burnt charge (e.g., exhaust gases) is discharged as described below.

The engine 64 operates on a four-stroke combustion principle and powers a propulsion device. The engine 64 has a cylinder body 100. Although not shown, the cylinder body 100 defines four cylinder bores generally horizontally extending and spaced generally vertically apart from each other. That is, the engine 64 is a L4 (in-line four cylinder)

type. This type of engine, however, is merely exemplary of a type with which various aspect and features of the present invention can be used. In addition to the illustrated engine type, the ventilation system 32 can be employed on engines and having other number of cylinders, having other cylinder arrangements.

A piston reciprocates in each cylinder bore. A cylinder head member 102 is affixed to one end of the cylinder body 100 and a cylinder head cover member 104 is affixed to cover the cylinder head member 102. The cylinder head member 102 and cylinder head cover member 104 together form a cylinder head assembly 106.

The other end of the cylinder body 100 is closed with a crankcase member 108 that defines a crankcase chamber with the cylinder body. A crankshaft 110 extends generally vertically through the crankcase chamber. The crankshaft 110 is pivotally connected to the pistons and rotates with the reciprocal movement of the pistons. Each piston has at least one piston ring on its periphery to isolate the combustion chamber from the crankcase chamber. In the illustrated embodiment, the crankcase member 108 is located at the most forward position, and the cylinder body 100 and the cylinder head assembly 106 extend rearwardly from the crankcase member 108.

The engine 64 includes an air induction system or device 114 and an exhaust system. The air induction system 114 is arranged to supply air charges to the combustion chambers and comprises a plenum chamber 116, main air delivery conduits 118 and intake ports. The intake ports are defined in the cylinder head assembly 106 and are opened or closed by intake valves. When the intake ports are opened, the air delivery conduits 118 communicate with the combustion chambers.

Figure 4:
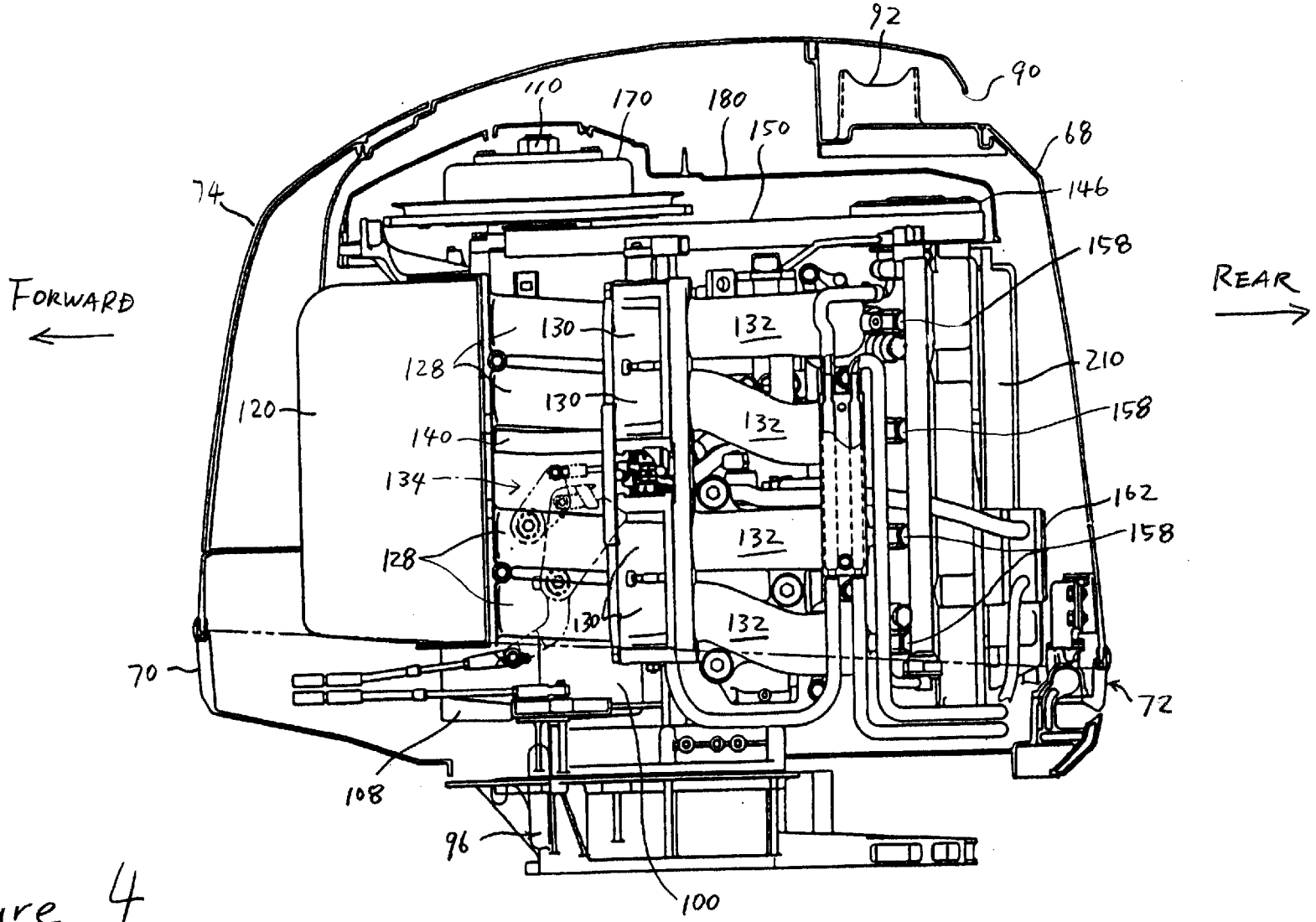
FIG. 4 is a side elevational view of the power head looking in the direction of Arrow 4 of FIG. 2 to particularly show the engine on the port side. The top cowling is sectioned generally along the center line of the cowling.
Figure 5:
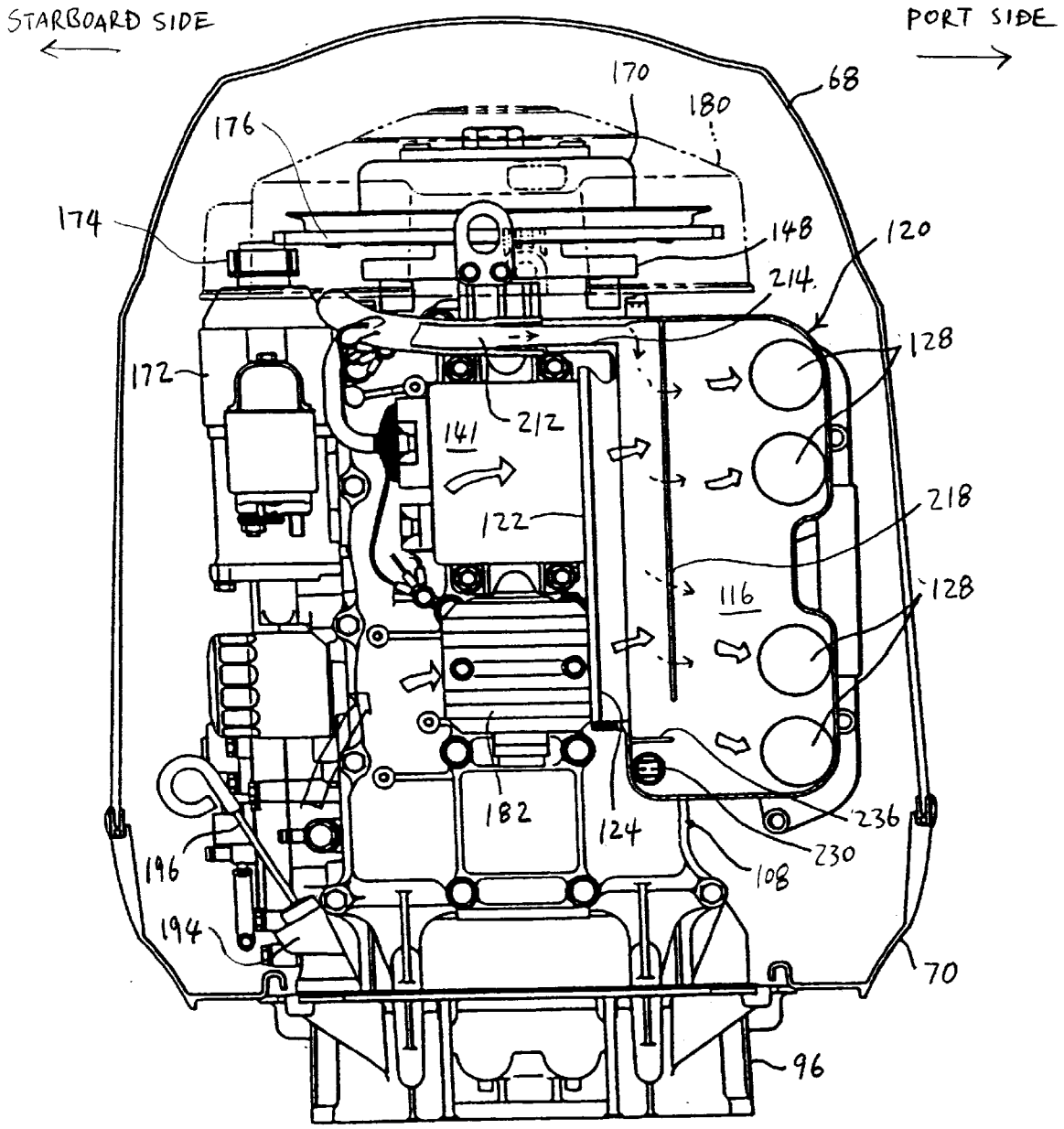
FIG. 5 is a front elevational view of the power head looking in the direction of Arrow 5 of FIG. 2. The top cowling, a bottom cowling and the air induction device are sectioned and an outer blow-by gas conduit also is partially sectioned. The air induction device and the outer blow-by gas conduit are somewhat schematically indicated. In i s addition, although indicated with an actual line, an intake air temperature sensor is positioned behind the section line.

The plenum chamber 116 functions as an intake silencer and a coordinator of air charges. In the illustrated embodiment, the plenum chamber 116 is defined in a plenum chamber member 120 positioned on the port side of the crankcase member 108. The air delivery conduits 118 extend rearwardly from the plenum chamber member 120 along a flank of the cylinder body 100 on the port side and then bend toward the intake ports. As seen in FIGS. 3 to 5, the plenum chamber member 116 is generally molded of a synthetic resin or cast and formed as a rectangular box in the side and rear views so that air can be introduced to the delivery conduits 118 evenly from the plenum chamber 116. The plenum chamber member 120 is affixed to the crankcase member 108.

The plenum chamber member 120 has an air inlet 122. An axis of the air inlet 122 extends generally normal to axes of the air delivery conduits 118. Since the delivery conduits 118 extends generally parallel to a horizontal axis of the cylinder body 100 that extends fore and aft, the axis of the air inlet 122 extends generally normal to this horizontal axis. A filter 124 is provided to cover the opening of the air inlet 122. In the illustrated embodiment, the filter 124 is a fine metal or meshed metal formed by a plurality of crossing wires. Thus, the filter 124 primarily inhibits objects from entering the plenum chamber 116 and further arrests backfire flames from the combustion chambers.

In the illustrated embodiment, as seen in FIG. 3, the bottom end of the aforenoted air duct 86 is positioned lower than the bottom end of the air inlet 122. Preferably, it is positioned at the same level as or lower than the bottom end of the plenum chamber member 120. Any moisture or water drop that are effectively separated from the air through this duct configuration drop down to the lower cowling 70 and not enter the air inlet 122. The water on the lower cowling 70 is discharged through openings in the lower cowling.

The inner construction of the plenum chamber member 120 will be described later.

The air delivery conduits 118 are preferably defined by delivery ducts 128, throttle bodies 130 and runners 132. The upper, two throttle bodies 130 are unified with each other, while the lower, two throttle bodies 130 are also unified with each other. Both throttle body units are further assembled and affixed to the cylinder body 100. The top runner 132 and the third runner 132 from the top extends generally horizontally. However, the second and fourth runners 132 are slightly downwardly curved downstream thereof to meet the respective intake ports. As best seen in FIG. 5, the respective delivery conduits 118 are generally spaced apart vertically so as to extend side by side with each other.

The respective throttle bodies 130 preferably support butterfly-type throttle valves therein for pivotal movement about axes of valve shafts extending generally vertically; however, other types of throttling devices can also be used to regulate air flow into the combustion chambers. The valve shafts are linked together to form a single valve shaft that passes through the entire assembly of throttle bodies 130. The throttle valves are operable by the operator through a suitable throttle cable and a linkage mechanism 134.

When the operator operates the throttle cable, the linkage mechanism 134 activates the valve shaft to open the throttle valves. Conversely, when the throttle cable is released, the linkage mechanism 134 activates the valve shaft to close the throttle valves.

The air induction system 114 further includes an idle air supply unit 138. The idle air supply unit 138 bypasses the throttle valves. An upstream bypass conduit 140 couples the unit 138 together with the plenum chamber 116, while a downstream bypass conduit 142 couples the unit 138 with one of the delivery conduits 118. The idle air supply unit 1 38 contains a valve member pivotally disposed therein. When the throttle valves in the throttle bodies 130 are almost closed at idle, the valve member in the idle air supply unit 138 is operated to supply necessary air to the combustion chambers under control of ECU (Engine Control Unit). The ECU is electrically operable and contained in an ECU box 141 (see FIG. 5).

The exhaust system is arranged to discharge burnt charges or exhaust gases outside of the outboard motor 30 from the combustion chambers. Exhaust ports are defined in the cylinder head assembly 106 and are opened or closed by exhaust valves. When the exhaust ports are opened, the combustion chambers communicate with exhaust passages which lead the exhaust gases downstream through the exhaust system.

Two camshafts 144 extend generally vertically and are disposed within the cylinder head assembly to activate the intake valves and exhaust valves. The camshafts 144 have cam lobes thereon to push the intake and exhaust valves at certain timings to open or close the respective ports. The camshafts 144 are journaled on the cylinder head member 102 and are driven by the crankshaft 110. The respective camshafts 144 have sprockets 146 thereon, while the crankshaft 110 also has a sprocket 148 thereon. A timing belt or chain 150 is wound around the sprockets 146, 148. With rotation of the crankshaft 110, the camshafts 144 also rotate. A tensioner 152 is provided to adjust the tension of the belt or chain 150 by pushing it inwardly so as to keep the opening and closing timing of the intake and exhaust valves accurate. The tensioner 152 includes, for example, a gas cylinder containing compressed gases therein to produce the tensioning force.

In the illustrated embodiment, the engine 64 has a fuel injection system, although other conventional fuel supply systems can be applied. The fuel injection system includes four fuel injectors 158 which have injection nozzles directed toward the intake ports. The fuel injectors 158 are supported by a fuel rail 160 that is affixed to the cylinder body 100.

The fuel injection system 158 further includes a vapor separator, a first low pressure fuel pump or manual pump, a second low pressure fuel pump 162, a high pressure fuel pump, a pressure regulator, a fuel supply tank and several fuel conduits connecting those components. The fuel supply tank and manual pump are disposed on a hull of the watercraft 40 and the other components described above are placed on the outboard motor 30. An amount of each fuel injection and injection timing are controlled by the ECU. The fuel injection system is well known in the art and no further description is believed necessary to practice the present invention.

Although not shown, the engine 64 further has a firing system. Four spark plugs are exposed into the respective combustion chambers and fire an air fuel charge at a proper timing. This firing timing is also controlled by the ECU. The air fuel charge is formed with an air charge supplied by the main air delivery conduits 118 or idle air supply unit 138 and a fuel charge sprayed by the fuel injectors 158. The burnt charge, as described above, is discharged outside through the exhaust system.

A flywheel assembly 170 is affixed atop the crankshaft 110. The flywheel assembly 170 includes a generator to supply electric power to the firing system, to the ECU and to other electrical equipment via a battery and/or directly.

A starter motor 172 is affixed on the cylinder body 100 in the vicinity of the flywheel assembly 170. A gear 174 of the starter motor 172 is meshed with a ring gear 176 provided on a periphery of the flywheel assembly 170 through a one-way clutch. The starter motor 172 rotates the crankshaft 110 via the flywheel assembly 170 when the operator operates a main switch. However, since the starter gear 174 and the ring gear 176 are coupled together by the one-way clutch, the crankshaft 110 cannot rotate the starter motor 172 immediately after starting of the engine 64.

A cover member 180 covers the flywheel assembly 170, starter motor 172, camshaft sprockets 146, 148 and the belt 150 for protection of the operator from such moving parts.

The electrical equipment includes a power source box 182 mounted on a front end of the crankcase member 108 and a relay box 184 mounted on a starboard side thereof except for the ECU box 141 that is affixed to the crankcase member 108 above the power source box 182.

The engine 64 has a cooling system that provides coolant to engine portions and also to exhaust passages in the driveshaft housing 60 because they generate significant heat during engine operations. In the illustrated embodiment, water is used as the coolant and is introduced from the body of water surrounding the outboard motor 30.

The water introduced into the cooling system is delivered to the portions which require cooling. After cooling such components, the water is discharged outside through a discharge conduit 188 and a discharge jacket formed in the cylinder body 100. A thermostat 190 is provided at the most upstream portion of the discharge conduit 188. If the temperature of the water is lower than a preset temperature, the thermostat will not allow the water to flow out to the discharge conduit 188 so that the engine 64 can warm up itself properly.

With reference back to FIG. 1, the driveshaft housing 60 depends from the power head 58 and supports a driveshaft which is driven by the crankshaft 110 of the engine 64. The driveshaft extends generally vertically through the exhaust guide 96 and then driveshaft housing 60. The driveshaft housing 60 also defines internal passages which form portions of the exhaust system. In the illustrated embodiment, an apron 192 covers an upper portion of the driveshaft housing 60.

The engine 64 has also a lubrication system. A lubricant reservoir depends from the exhaust guide 96 within the driveshaft housing 60. A lubricant pump is driven by the driveshaft to supply lubricant to engine components that need lubrication. The lubricant then drains to the lubricant reservoir.

The engine components that need lubrication include the pistons that furiously reciprocate within the cylinder bores. The pistons need the lubrication not to seize on surfaces of the cylinder bores. The aforenoted piston rings can remove the oil from the surfaces of the cylinder bores and carry out to the crankcase chambers.

The lubricant reservoir includes an oil inlet 194 and an oil gauge 196. The oil gauge 196 is employed for checking quality and quantity of the lubricant in the reservoir. The oil gauge 196 is usually used for plugging up the oil inlet 194 and taken out from the inlet 194 only when checking the lubricant.

The lower unit 62 depends from the driveshaft housing 60 and supports a propulsion shaft which is driven by the driveshaft. The propulsion shaft extends generally horizontally through the lower unit 62 when the outboard motor is in a fully tilted down position. In the illustrated embodiment, the propulsion device includes a propeller 200 that is affixed to an outer end of the propulsion shaft and is driven by the propeller shaft. The propulsion device, however, can take the form of a dual, counter-rotating propeller system, a hydrodynamic jet, or the like propulsion device.

A transmission is provided between the driveshaft and the propeller shaft. The transmission couples together the two shafts which lie generally normal to each other (i.e., at a 90° shaft angle) with a bevel gear train or the like.

The transmission has a switchover or clutch mechanism to shift rotational directions of the propeller 200 to forward, neutral or reverse. The switchover mechanism is operable by the operator through a shift linkage including a shift cam, a shift rod and a shift cable.

The lower unit 62 also defines an internal passage that forms a discharge section of the exhaust system. At engine speed above idle, the majority of the exhaust gases are discharged to the body of water surrounding the outboard motor 30 through the internal passage and finally through a hub of the propeller 200, as well known in the art.

Additionally, the driveshaft housing 60 has a water pump that is driven by the driveshaft and supplies cooling water to the aforenoted cooling system. Water is introduced through a water inlet which opens at the lower unit 62. The water inlet is connected to the water pump through an inlet passage, while the water pump is connected to the respective portions that need the cooling water through a supply passage. The supply passage, then, diverges to a plurality of water passages and jackets in the engine 64.

With reference primarily to FIGS. 2 to 5, the blow-by gas ventilation system 32 will now be described in greater detail.

Although the combustion chambers are isolated from the crankcase chambers by the piston rings, actually some of the combustion gases and unburnt charges can go into the crankcase chamber. These gases and charges, i.e., blow-by gases, desirably are removed from the crankcase chamber. The ventilation system 32 is provided to remove the blow-by gases.

The ventilation system 32 principally comprises an inner blow-by gas conduit, an oil separator or breather 210 and an outer blow-by gas conduit 212. The inner conduit is formed internally between the crankcase member 108, cylinder body 100 and cylinder head assembly 106 and connects the crankcase chamber to an uppermost portion of the oil separator 210. The oil separator 210 is mounted on the cylinder head assembly 106 and can be integrally or unitarily (at least in part) formed with the assembly 106. The oil separator 210 has a labyrinth construction therein to separate an oil component from the blow-by gases because the blow-by gases may contain a portion of the lubricant that has been used for the lubrication of the pistons. The outer blow-by gas conduit 212 couples an outer, uppermost portion of the oil separator 210 to the plenum chamber member 120. The outer conduit 212 extends forwardly from the separator 210 along generally upper portions of the cylinder head assembly 106, cylinder body 100 and crankcase member 108 on the starboard side in the illustrated embodiment. That is, the outer conduit 212 lies on the opposite side of the air delivery conduits 118.

As best seen in FIG. 2, in the illustrated embodiment, the outer blow-by gas conduit 212 generally makes a right-angled turn toward the plenum chamber member 120 immediately forwardly of the crankcase chamber 108. A hollow coupling portion 214 extends from the plenum chamber member 120 toward the outer conduit 212 to receive the end portion of the conduit 212. Thus, the outer blow-by gas conduit 212 and the plenum chamber member 120 are coupled together. In the illustrated embodiment, the coupling portion 214 is positioned atop of the plenum chamber member 120 and defines an opening to which the outer blow-by gas conduit 212 is connected.

The axis of the aforenoted air inlet 122 extends generally parallel to an axis of the outer blow-by gas conduit 212 existing at the coupling portion 214 because both of the air inlet 122 and the coupling portion 214 extend generally in parallel to each other from the chamber member 120. In addition, the axis of the outer blow-by gas conduit 212 existing at the coupling portion 214 extends generally normal to the air delivery conduits 118.

The coupling portion 214 can be formed separately from the plenum chamber member 120 as a coupling pipe or the like and can be joined to an opening of the chamber member 120. Otherwise, the coupling portion 214 or coupling pipe may be omitted and the outer conduit 212 can be joined to the opening of the chamber member 120 directly.

The plenum chamber member 120 has a baffle 218, which interrupts a flow of the blow-by gases, disposed in front of the coupling portion 214. The baffle 218 preferably is uniformly molded within the plenum chamber member 120 and is formed as a thin member or plate shape; however, the baffle 218 can be a separate member disposed and mounted within the plenum chamber member 120. As best seen in FIGS. 2, the baffle 218 extends generally forwardly from a rear inner wall of the chamber member 120. As seen in FIGS. 2 and 3 though, it does not extend beyond the air inlet 122 so as not to inhibit the smooth air flow within the plenum chamber member 120. Also, the baffle 218 extends generally normal to the axes of the air inlet 122 and the coupling portion 214. Further, as best seen in FIG. 5, it extends generally vertically and downwardly from a top inner wall of the chamber member 120.

In addition, as seen in FIG. 3, the baffle 218 is formed as an inverted triangle that depends from the top inner wall in the illustrated embodiment. This is because the coupling portion 214 is positioned atop of the plenum chamber member 120 while the respective air delivery conduits 118 are disposed side by side and vertically above one another. That is, air in the plenum chamber 116 is drawn toward the combustion chambers by the evacuating force generated when the pistons move toward the crankcase chamber during its intake stroke. If the baffle 218 is configured as a rectangular shape, the air will most likely enter the top delivery conduit 118 positioned. The higher the delivery conduit 118 is placed, the easier the blow-by gases enter the conduit 118 in this construction. The inverted triangle improves uniform distribution of the blow-by gases between the respective delivery conduits 118. In other words, the blow-by gases can be evenly distributed to the respective delivery conduits 118 because of the inverted triangle configuration. The inverted triangle interrupts the flow of blow-by gases toward the delivery conduits 118, but the interruption decreases gradually toward the bottom of the chamber 116.

In general, where air delivery conduits are disposed side by side and an opening to which the blow-by gas conduit is connected is positioned in proximity to at least one of the air delivery conduits, a portion of the baffle located far from the opening provides an interruption smaller than an interruption provided by another portion of the baffle located nearer to the opening. Thus, in the illustrated embodiment, the baffle has an inverted triangular shape, but it can take other shapes in accordance with the above criteria with different arrangements of the opening and the conduits.

For example, if the coupling portion 214 is placed at the lowermost position of the plenum chamber member 120, the baffle 218 should have a simple triangle configuration that is not inverted. Likewise, if the coupling portion 214 is placed at middle position of the chamber member 120, the baffle 218 should have a chevron configuration.

Moreover, such a configuration provides different degrees of resistance to the flow of blow-by gases when it goes through a path defined between the baffle 218 and an inner wall of the chamber member 120 in proportion to portions of the path. That is, the wider the path is formed, the easier the blow-by gases can flow. Thus, for instance, if the plenum chamber member 120 is configured as a trapezoid, the baffle 218 may be configured as a rectangular. As a result, where air delivery conduits are disposed side by side and an opening to which the blow-by gas conduit is connected is positioned in proximity to at least one of the air delivery conduits, a path for the blow-by gases which is defined between the baffle and an inner wall of a plenum chamber member should be narrowed in a vicinity of the opening.

As noted above, the ECU controls the engine operations including the fuel injection system. In order to determine appropriate control indexes in control maps, which are stored within and used by ECU, or to calculate them based upon the control indexes determined in the maps, various sensors are provided for sensing engine conditions and other environmental conditions in accordance with control strategies. The sensors may include, for example, a throttle valve position sensor, an intake air temperature sensor, an intake air pressure sensor, a water temperature sensor and a crankshaft angle position sensor.

In the illustrated embodiment, the ECU determines an amount of intake air based upon a throttle opening signal sensed by the throttle valve position sensor and an intake air temperature signal sensed by the intake air temperature sensor. Then, the ECU controls an amount of fuel injection in response to the determined intake air amount and an engine speed signal sensed by the crankshaft angle position sensor on a feed-back control principle so that an actual air fuel ratio is consistent with or approaches to an aimed air fuel ratio.

The intake air temperature sensor, which is now designated by the reference numeral 230, preferably is mounted on the plenum chamber member 120. The plenum chamber member 120 has a recess 232 formed at a bottom thereof. The recess 232 is sunken inward and a large part of the sensor 230 is positioned within the recess 232. Thereby, the part of the sensor 230 is well protected from being damaged even when the top cowling 68 is put on and taken off. The sensor 230 is affixed to a forward wall of the recess 232 of the chamber member 120 so that its sensor element 234 is positioned within the plenum chamber 116 because it is desirable to accurately determine the intake air amount and hence the sensor element 234 needs to sense the air temperature in the plenum chamber 116.

As seen in FIGS. 2, 3 and 5, the sensor element 234 is disposed generally below a portion of the plenum chamber member 120 from which the coupling portion 214 extends. Also, the sensor element 234 is positioned below and in a vicinity of a bottom end of the baffle 218. Although almost of the oil component has been removed from the blow-by gases before entering the combustion chamber 116, a very small amount of the oil component still remains and may drop onto the sensor element 234. If the oil component deposits on the sensor element 234 and adheres thereto, the detection characteristic of the intake air temperature sensor 230 may decline and the ECU cannot accurately control the air/fuel ratio.

In order to protect the sensor element 234 and preclude the oil component from adhering thereto, a cover portion 236 extends between the opening where the blow-by gases enter and the sensor element 234. In the illustrated embodiment, the cover portion 236 protrudes above the sensor element 234 like a visor from the inner wall of the chamber member 120. Although the cover portion 236 is unitarily molded with the chamber member 120, it can be separately formed and be affixed to the chamber member 120. As seen in FIG. 5, the cover portion 236 is provided lower than the air inlet 124 not to interrupt the air flow.

Ambient air is introduced into the interior of the cowling assembly 66 through the front and rear air intake openings 76, 90 and also front and rear air ducts 86, 92. The air introduced through the rear section travel primarily about the engine components such as the cylinder head assembly 106 and cylinder body 100 which may have heat during engine operations. The air carries the heat away and then enters the plenum chamber 116 through the air inlet 122. Meanwhile, the air introduced through the front section, as indicated by the white-out arrows of FIGS. 2, 3 and 5, goes down to the bottom of the cowling assembly 66 and also cools the ECU box 141, the power source box 182 and the relay box 184 and then enter the plenum chamber 116 through the air inlet 122. The air that enters the air inlet 122 move to the respective air delivery conduits 128 and then reaches the combustion chambers through the intake ports when the intake valves are opened for combustion. Neither the baffle 218 nor the cover portion 236 will disturb the movement of the air because these elements are out of the air flow path between the air inlet 122 and the delivery conduits 128.

On the other hand, as indicated by the dotted arrows of FIGS. 3 and 5, the blow-by gases flow through the oil separator 210 from the crankcase chamber through the inner blow-by gas conduits. The oil component of the blow-by gases is removed when the gases travel through the labyrinth from the top to the bottom and then the bottom to the top within the oil separator 210 and is discharged back to the lubricant reservoir. The blow-by gases then move to the plenum chamber member 120 through the outer blow-by gas conduit 212. Since the baffle 218 is disposed in front of the opening, i.e., the coupling portion 214, as described above, the flow of the blow-by gases is interrupted by the baffle 218 and evenly distributed to the respective delivery conduits 128 because of the aforenoted configuration of the baffle 218. The blow-by gases move with the air charge toward the combustion chambers to be burnt therein.

As described above, in the illustrated embodiment, the baffle having such an inverted triangle configuration is provided in front of the opening of the plenum chamber where the blow-by gases enter. Thus, the blow-by gases can be evenly distributed between the respective cylinders.

The opening can be placed at any position on the plenum chamber. For instance, the lowermost position and also a midway position are available.

Various configurations of the baffle can be applicable in conformity with positions of the opening and the delivery conduits and also configurations of the plenum chamber member. The baffle configuration can be selected in accordance with the principles of the present invention.

Any connecting construction can be applicable between the plenum chamber and the outer blow-by gas conduit. For instance, the coupling portion of the plenum chamber can be omitted and the outer blow-by gas conduit may be joined to an opening of the plenum chamber directly as noted above.

The aforenoted intake air pressure sensor can be provided within the plenum chamber 116 together with the intake air temperature sensor. This arrangement can enhance the air fuel ratio control. The air pressure sensor also is preferably protected from the oil component of the blow-by gas by a cover (e.g., by the cover portion 236).

Of course, the foregoing description is that of a preferred embodiment of the invention, and various changes and modifications may be made without departing from the spirit and scope of the invention, as defined by the appended claims.

What is claimed is:

1. A ventilation system for a crankcase of an internal combustion engine having an air induction device including a plurality of air delivery conduits and a plenum chamber-member disposed upstream of the air delivery conduits, the ventilation system comprising a blow-by gas conduit communicating with the crankcase and with the plenum chamber member, the plenum chamber member including an opening to which the blow-by gas conduit is connected, and a baffle disposed in front of the opening within the plenum chamber member.

2. A ventilation system as set forth in claim 1, wherein the air delivery conduits are disposed in side by side arrangement, the opening is positioned in proximity to at least one of the air delivery conduits, and a portion of the baffle, which is located farther from the opening, is smaller to provide less of an interruption than another portion of the baffle, which is located nearer the opening.

3. A ventilation system as set forth in claim 2, wherein the opening is positioned closer to an air delivery conduit, which is disposed at an end of the side by side arrangement of the delivery conduits, and the baffle gradually reduces in size toward the opposite end of the side by side arrangement of the delivery conduits.

4. A ventilation system as set forth in claim 3, wherein the baffle generally has a triangular shape.

5. A ventilation system as set forth in claim 1, wherein the air delivery conduits are spaced apart and arranged above one another, the opening is positioned atop of the plenum chamber member, and the baffle gradually decreases in size toward a bottom of the plenum chamber member.

6. A ventilation system as set forth in claim 1, wherein the baffle is formed generally as a thin member.

7. A ventilation system as set forth in claim 6, wherein the thin member is unified with the plenum chamber member.

8. A ventilation system as set forth in claim 1, wherein the air delivery conduits are disposed in a side by side arrangement, the opening is positioned in proximity to at least one of the air delivery conduits, and a path for the blow-by gas which is defined between the baffle and an inner wall of the housing is narrowed in a vicinity of the opening.

9. A ventilation system as set forth in claim 1, wherein the baffle extends generally normal to a flow of the blow-by gas that passes through the opening.

10. A ventilation system as set forth in claim 1, wherein the plenum chamber member includes an air inlet disposed on one side thereof, and the opening is disposed on the same side.

11. A ventilation system as set forth in claim 10, wherein an axis of the air inlet extends generally parallel to an axis of a portion of the blow-by gas conduit existing at the opening.

12. A ventilation system as set forth in claim 10, wherein the air delivery conduits extend generally normal to an axis of a portion of the blow-by gas conduit existing at the opening.

13. A ventilation system as set forth in claim 1 additionally comprising an intake air temperature sensor disposed generally below the opening within the plenum chamber member.

14. A ventilation system as set forth in claim 13, wherein the temperature sensor is positioned in a vicinity of a bottom end of the baffle.

15. A ventilation system as set forth in claim 13, wherein the plenum chamber member has a cover portion that extends between the opening and the temperature sensor.

16. A ventilation system as set forth in claim 13, wherein the plenum chamber member has a concave recess formed at a bottom thereof and a portion of the temperature sensor is positioned within the recess.

17. A ventilation system as set forth in claim 16, wherein the temperature sensor is mounted on the plenum chamber member, and at least a sensor element thereof is positioned within the plenum chamber member.

18. A ventilation system as set forth in claim 1, wherein the blow-by gas conduit includes an oil separator.

19. An air induction device for an internal combustion engine comprising a plurality of air delivery conduits, a plenum chamber member disposed upstream of the delivery conduits, a blow-by gas inlet provided on the plenum chamber member, a blow-by gas conduit distributing blow-by gas to the blow-by gas inlet from the engine, and a baffle disposed in front of the blow-by gas inlet within the plenum chamber member.

20. An air induction device as set forth in claim 19, wherein the air delivery conduits are disposed side by side, the blow-by gas inlet is positioned in proximity to at least one of the air delivery conduits, and a portion of the baffle, which is located farther from the blow-by gas inlet, is smaller than another portion of the battle which is located nearer to the opening.

21. An air induction device as set forth in claim 19, wherein the air delivery conduits are spaced apart from and arranged above one another, the blow-by gas inlet is positioned atop of the plenum chamber member, and the baffle gradually decreases in size toward a bottom of the plenum chamber member.

22. An air induction device as set forth in claim 21, wherein the air delivery conduits are disposed in a side by side arrangement, the opening is positioned in proximity to at least one of the air delivery conduits, a path for the blow-by gas is defined between the baffle and an inner wall of the housing, and the path is narrowed in a vicinity of the blow-by gas inlet.

23. An internal combustion engine comprising a plurality of combustion chambers, an air intake system including a plurality of air delivery conduits and a plenum chamber member, the delivery conduits being connected to the respective combustion chambers, the plenum chamber being disposed upstream of the air delivery conduits, a crankcase, a ventilation system including a blow-by gas conduit coupling the crankcase with the plenum chamber member, and the plenum chamber member having an opening to which the blow-by gas conduit is connected and a baffle disposed in front of the opening within the housing.

24. A ventilation system as set forth in claim 23, wherein the engine operates on a four-stroke combustion principle.

25. A ventilation system as set forth in claim 23, wherein the engine is employed for powering a marine propulsion device.

* * * * *